US010395866B2

(12) United States Patent
Chung et al.

(10) Patent No.: US 10,395,866 B2
(45) Date of Patent: Aug. 27, 2019

(54) HIGH VOLTAGE DC CIRCUIT BREAKER

(71) Applicant: HYOSUNG HEAVY INDUSTRIES CORPORATION, Seoul (KR)

(72) Inventors: Young Hwan Chung, Changwon-si Gyeongsangnam-do (KR); Hui Dong Hwang, Changwon-si Gyeongsangnam-do (KR); Nam Kyung Kim, Changwon-si Gyeongsangnam-do (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 0 days.

(21) Appl. No.: 15/540,935

(22) PCT Filed: Dec. 24, 2015

(86) PCT No.: PCT/KR2015/014286
§ 371 (c)(1),
(2) Date: Jun. 29, 2017

(87) PCT Pub. No.: WO2016/108524
PCT Pub. Date: Jul. 7, 2016

(65) Prior Publication Data

US 2017/0352508 A1 Dec. 7, 2017

(30) Foreign Application Priority Data

Dec. 29, 2014 (KR) ..... 10-2014-0192740

(51) Int. Cl.
*H01H 33/59* (2006.01)
*H01H 33/66* (2006.01)
(Continued)

(52) U.S. Cl.
CPC ..... *H01H 33/596* (2013.01); *H01H 33/59* (2013.01); *H01H 33/593* (2013.01);
(Continued)

(58) Field of Classification Search
CPC .... H01H 33/596; H01H 33/593; H01H 33/66; H01H 33/664
See application file for complete search history.

(56) References Cited

U.S. PATENT DOCUMENTS 4,172,268 A * 10/1979 Yanabu ..... H01H 33/596 307/134
4,229,681 A * 10/1980 Plumb ..... H05B 41/392 315/244
(Continued)

FOREIGN PATENT DOCUMENTS

JP 1984-068128 A 4/1984
JP 2003-123569 A 4/2003
(Continued)

*Primary Examiner* — Daniel Kessie
(74) *Attorney, Agent, or Firm* — Novick, Kim & Lee, PLLC; Jae Youn Kim

(57) ABSTRACT

Provided is a high voltage DC circuit breaker that interrupts a fault current flowing through a high voltage DC transmission line with a vacuum circuit breaker and a gas circuit breaker connected in series. The circuit breaker includes: a vacuum circuit breaker installed on a DC transmission line and operating to interrupt a current in the DC transmission line when a fault occurs on either side of the DC transmission line; a gas circuit breaker connected in series with the vacuum interrupter; an LC circuit connected in parallel with the vacuum circuit breaker and including a capacitor and a reactor connected in series to induce LC resonance; a first bidirectional switching device connected in series with the LC circuit and switching a current flowing in any of two opposite directions; and a second bidirectional switching device connected in parallel with the LC circuit.

3 Claims, 5 Drawing Sheets

(51) Int. Cl.
*H01H 33/664* (2006.01)
*H01H 9/54* (2006.01)

(52) U.S. Cl.
CPC ..... *H01H 33/66* (2013.01); *H01H 33/664* (2013.01); *H01H 2009/544* (2013.01)

(56) References Cited

U.S. PATENT DOCUMENTS

| | | | | | |
|---|---|---|---|---|---|
| 4,578,730 | A * | 3/1986 | Tokuyama | H01H 33/596 | 307/126 |
| 4,618,905 | A * | 10/1986 | Tokuyama | H01H 33/596 | 361/13 |
| 5,392,184 | A * | 2/1995 | Unterlass | H02H 7/16 | 361/15 |
| 9,413,157 | B2 * | 8/2016 | Tahata | H02H 3/087 | |
| 2015/0002977 | A1 * | 1/2015 | Dupraz | H01H 9/542 | 361/115 |
| 2016/0028222 | A1 * | 1/2016 | Johansson | H01H 9/541 | 361/91.1 |
| 2016/0028360 | A1 * | 1/2016 | English | G05F 3/16 | 323/208 |
| 2016/0322178 | A1 * | 11/2016 | Park | H01H 9/30 | |
| 2017/0271100 | A1 * | 9/2017 | Ka | H01H 9/54 | |
| 2017/0288388 | A1 * | 10/2017 | Horinouchi | H01H 77/02 | |

FOREIGN PATENT DOCUMENTS

| | | | |
|---|---|---|---|
| JP | 2009-181908 | A | 8/2009 |
| JP | 2014-175077 | A | 9/2014 |
| KR | 10-2000-0060552 | A | 10/2000 |
| KR | 10-2012-0064504 | A | 6/2012 |

* cited by examiner

HIGH VOLTAGE DC CIRCUIT BREAKER

TECHNICAL FIELD

The present invention relates to a high voltage DC circuit breaker and, more particularly, to a high voltage DC circuit breaker that interrupts a fault current flowing through a high voltage DC transmission line with a configuration in which a vacuum circuit breaker and a gas circuit breaker are connected in series with each other.

BACKGROUND ART

Generally, a high voltage DC circuit breaker refers to a switching device that can interrupt an electric current flowing through a high voltage (i.e. 15 kV or higher) transmission line, such as a high voltage direct current (HVDC) transmission system. The high voltage DC circuit breaker functions to interrupt a fault current when a certain fault occurs in a DC transmission line. This also can be applied to a medium voltage DC distribution system that distributes electric power of medium-level voltages ranging from 1 to 50 kV.

As to a high voltage DC circuit breaker, when a fault current occurs in a system, a main switch is opened to disconnect a faulty circuit, thereby interrupting the flow of a fault current from the faulty circuit. However, since there is no zero current point on a DC transmission line, when a main switch is opened, an arc generated between terminals of the main switch is not extinguished. Therefore, a fault current flows through the arc. That is, the fault current fails to be interrupted.

FIG. 1 shows the technology of a high voltage DC circuit breaker disclosed by Japanese Patent Application Publication No. 1984-068128. According to this technology, in order to interrupt a fault current $I_c$ by extinguishing an arc generated when a main switch CB is switched off, the high voltage DC circuit breaker superposes a resonance current of an LC circuit on a DC current IDC flowing through the main switch CB (i.e. $I_{dc}=I_{DC}+I_P$), thereby creating a zero current point in the main switch CB. That is, when the main switch CB is closed, the resonance current $I_p$ is supplied to be superposed on the DC current $I_{DC}$. Then, the resonance current $I_p$ becomes an oscillating current due to the LC resonance, and is amplified while passing through the main switch CB. Thus, when the magnitude of a negative resonance current $-I_p$ increases to be larger than that of the DC current $I_{DC}$, the fault current Ic becomes zero, and the arc in the main switch is extinguished. However, this conventional technology has the following problems: it needs to have a circuit rating two times larger than a rated current because a resonance current $I_p$ larger than the DC current $I_{DC}$ needs to be superposed on the DC current $I_{DC}$; and interruption speed is slow because multiple resonance cycles are required to generate a large resonance current $I_p$. In addition, the conventional DC circuit breaker has a problem that it cannot interrupt fault currents flowing in both forward and backward directions.

In order to solve these problems, a vacuum interrupter (VI) has been developed to prevent an arc from being generated when a main switch CB is switched off. However, it is difficult to apply an existing vacuum interrupter to a high voltage DC circuit breaker due to a low rated voltage thereof.

DISCLOSURE

Technical Problem

Accordingly, the present invention has been made keeping in mind the above problems occurring in the related art, and an object of the present invention is to provide a high voltage DC circuit breaker having a configuration in which a gas circuit breaker and a vacuum circuit breaker are connected in series such that, when a fault occurs in a DC transmission line, the vacuum circuit breaker having a low rated voltage and a high current interruption performance primarily interrupts a fault current and the gas circuit breaker subsequently operates to provide a dielectric strength.

Another object of the present invention is to provide a high voltage DC circuit breaker in which a gas circuit breaker operates a predetermined time after the gas circuit breaker operates, in which the gas circuit breaker starts operating before the operation period of the vacuum circuit breaker 110 terminates such that operation times of the vacuum circuit breaker and the gas circuit breaker partially overlap.

Technical Solution

In order to accomplish the above object, according to one aspect, there is provided a high voltage DC circuit breaker ac including:

a vacuum circuit breaker installed on a direct current (DC) transmission line to interrupt a current in the DC transmission line by operating when a fault occurs on one side or a remaining side on the DC transmission line; an LC circuit connected in parallel with the vacuum circuit breaker 110 and including a capacitor and a reactor connected in series with each other to induce LC resonance; a first bidirectional switching device connected in series with the LC circuit and switching currents flowing in both forward and backward directions; and a second bidirectional switching device connected in parallel with the LC circuit and switching currents to induce LC resonance in both forward and backward directions.

In the present invention, the high voltage DC circuit breaker further includes a charging resistor to charge the capacitor 131 to a voltage Vc, and the charging resistor 160 is provided between a ground and a contact point between the LC circuit and the first bidirectional switching device.

In the present invention, the first and second bidirectional switching devices respectively include a pair of switches G1 and G2 connected in parallel and arranged to be counter to each other and a pair of switches G3 and G3 connected in parallel and arranged to be counter to each other, in which the switches G1 to G4 are turn-on controllable switches or turn-on/turn-off controllable switches.

In the present invention, when a fault occurs at the one side on the DC transmission line, a current in the DC transmission line is interrupted in the following manner: while two contacts of the vacuum circuit breaker are separated from each other, in a state in which the switches G1 and G2 of the first bidirectional switching device are in an OFF state, one switch G4 of the second bidirectional switching device is turned on such that the capacitor is charged to a voltage −Vc through the LC resonance between the reactor and the capacitor of the LC circuit; and subsequently the switch G4 is turned off and the switch G2 of the first bidirectional switching device is turned on such that the vacuum circuit breaker is supplied with a current due to the voltage −Vc charged in the capacitor; and the current supplied from the capacitor makes a zero current between the two contact points of the vacuum circuit breaker.

In the present invention, when a fault occurs at the remaining side of the DC transmission line, a current in the DC transmission line is interrupted in the following manner: while two contacts of the vacuum circuit breaker are separated from each other, in a state in which the switches G3 and G4 of the second bidirectional switching device are in an OFF state, the switch G1 of the first bidirectional switching device is turned such that the vacuum circuit breaker is supplied with a current due to the voltage +Vc that is preliminarily charged in the capacitor of the LC circuit; and the supplied current makes a zero current between the two contacts of the vacuum circuit breaker.

In the present invention, when a predetermined time elapses from operation of the vacuum circuit breaker in which the contacts of the vacuum circuit breaker are separated from each other, the gas circuit breaker operates. That is, the gas circuit breaker starts operating before the vacuum circuit breaker stops operating, such that there is an operation overlap period during which both of the vacuum circuit breaker and the gas circuit breaker operate.

Advantageous Effects

As described above, according to the present invention, since the vacuum circuit breaker and the gas circuit breaker in the high voltage DC circuit breaker are connected in series with each other, it is possible to exploit both a good arc extinguishing performance of a vacuum medium and a high voltage withstanding performance of a gas.

In addition, in the high voltage DC circuit breaker according to the present invention, when a fault occurs on a DC transmission line, the vacuum circuit breaker primarily interrupts a fault current, and the gas circuit breaker connected in series with the vacuum circuit breaker subsequently operates only to recover dielectric strength. Therefore, some parts such as an arc contact used for arc extinguishment and a gas blower nozzle, which were necessarily provided in conventional circuit breakers, are not required. In addition, since the non-linear resistor is provided only in the vacuum circuit breaker and it is not necessary for the gas circuit breaker to be provided with the non-linear resistor, the number of the non-linear resistors can be reduced. Therefore, it is possible to reduce the size and cost of the DC circuit breaker.

In addition, according to the present invention, a vacuum circuit breaker for a high voltage of 145 kV or higher, which is currently difficult to implement due to technical constraints, is not required, it is possible to increase feasibility of a high voltage DC circuit breaker for 320 kV or higher.

MODE FOR INVENTION

Hereinafter, a preferred embodiment of the present invention will be described with reference to the accompanying drawings. In addition, descriptions of known functions or constructions which have been deemed to unnecessarily obscure the gist of the present invention will be below.

Figure 2:
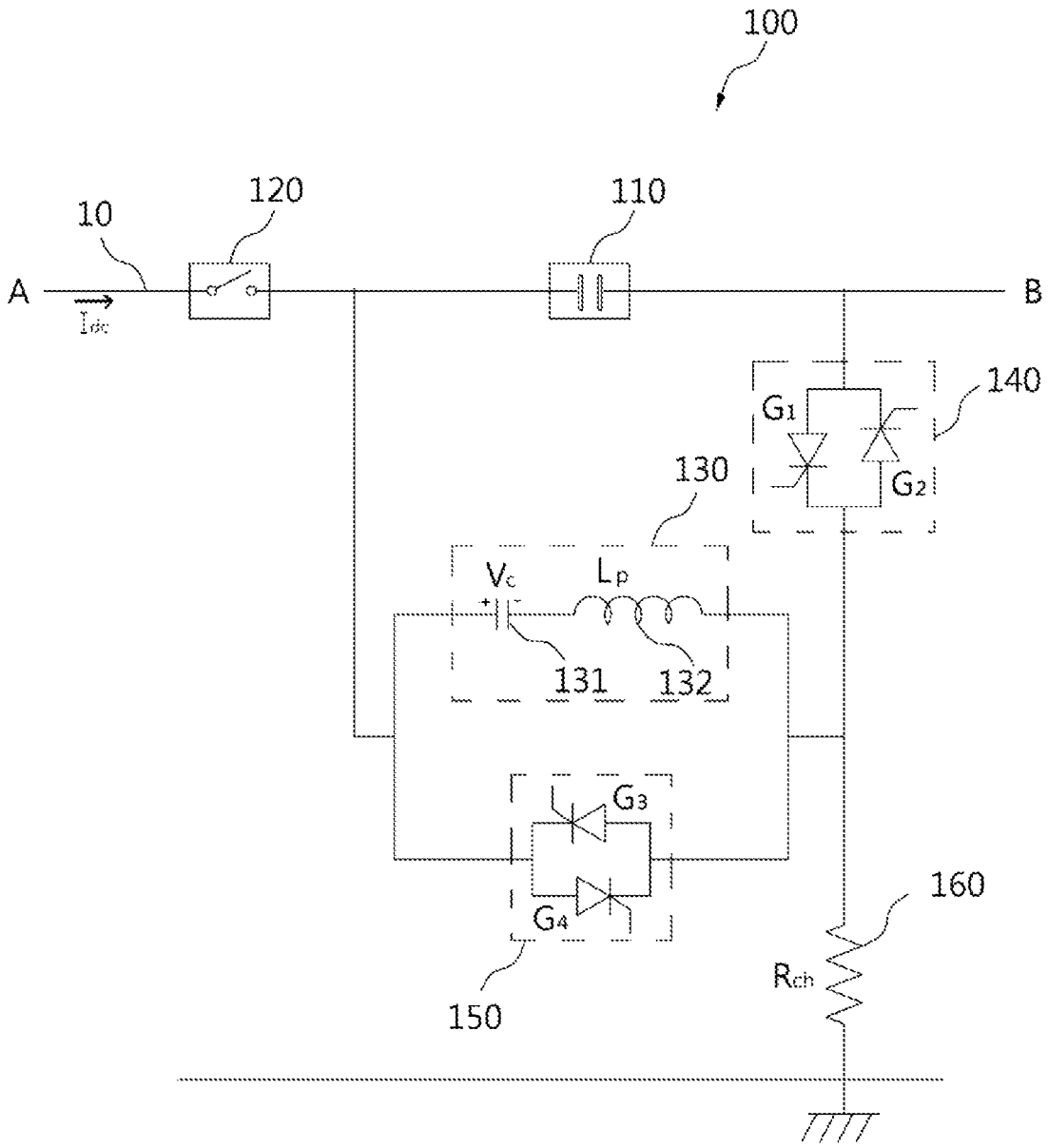
FIG. 2 is a configuration diagram of a high voltage DC circuit breaker according to one embodiment of the present invention.

FIG. 2 is a configuration diagram of a high voltage DC circuit breaker according to one embodiment of the present invention.

With reference to FIG. 2, according to one embodiment of the present invention, a high voltage DC circuit breaker 100 includes a vacuum circuit breaker 110 installed on a DC transmission line 10 connecting an A side and a B side to each other. The vacuum circuit breaker 110 blocks the DC transmission line 10 when a fault occurs at one side (B side) or the remaining side (A side) such that a fault current cannot flow continuously to a faulty circuit. To this end, the vacuum circuit breaker 110 has two contacts that are normally in contact with each other but are separated from each other to interrupt the flow of a current when a fault occurs. The contact and separation of the contacts of the vacuum circuit breaker 110 are controlled by a controller (not shown). According to the embodiment, the vacuum circuit breaker 110 includes a vacuum interrupter (VI).

The vacuum circuit breaker 110 is connected in series with a gas circuit breaker 120. The gas circuit breaker 120 includes a gas circuit breaker (GCB) using gas such as $SF_6$, thereby having a high insulation performance and a high arc extinguishment performance.

In the high voltage DC circuit breaker 110 according to the present invention, the vacuum circuit breaker 110 and the gas circuit breaker 120 are provided on a DC transmission line and connected in series with each other. When a fault occurs at one side or the remaining side on the DC transmission line, in order to interrupt a fault current flowing through the DC transmission line, the vacuum circuit breaker 110 primarily operates, and the gas circuit breaker 120 subsequently operates after a predetermined time elapses from the beginning of the operation of the vacuum circuit breaker 110. Specifically, the vacuum circuit breaker 110 operates such that two contacts therein separate from each other to interrupt a fault current in the DC transmission line. When a predetermined time elapses after the vacuum circuit breaker 110 operates such that the two contacts thereof separate from each other, the gas circuit breaker 120 starts operating. In this case, the gas circuit breaker 120 starts operating before a preset operation period of the vacuum circuit breaker 110 terminates. Thus, there is an operation overlap period during which both of the two circuit breakers 110 and 120 operate together. This operation time setting is designed for the reason described below. Namely, when a high voltage is applied to the high voltage DC transmission line, while the vacuum circuit breaker 110 interrupts a fault current, the gas circuit breaker 120 is supposed to provide a dielectric strength to withstand the high voltage. That is, the interruption of a fault current is performed by the vacuum circuit breaker 110 having a relatively low rated voltage and a high current interruption performance, and the recovery of a dielectric strength after application of the high voltage is performed by the gas circuit breaker 120. As described above, the gas circuit breaker 120 does not perform a current interruption function. Therefore, it is not necessary for the gas circuit breaker 120 to include parts for arc extinguishment, such as an arc contact, a nozzle, or the like, which were necessarily provided in conventional gas circuit breakers.

According to the embodiment of the present invention, when a high voltage is applied to the DC transmission line 10, a large amount of current flows through the vacuum circuit breaker 110. For this reason, when a fault occurs, the vacuum circuit breaker 110 operates such that its two contacts separate from each other. Due to the separated contacts, a fault current is interrupted. In this case, since a high voltage is applied between the two contacts, an additional device is required to rapidly interrupt a large amount of fault current.

Specifically, in the high voltage DC circuit breaker 100 according to the embodiment of the present invention, a series-connected circuit of an LC circuit 130 and a first bidirectional switching device 140 is connected in parallel with the vacuum circuit breaker 110. In addition, a second bidirectional switching device 150 is connected in parallel with the LC circuit 130. The LC circuit 130 includes a capacitor 131 and a reactor 132 connected in series. The bidirectional switching devices 140 and 150 respectively include a pair of switches G1 and G2 connected in parallel and arranged to be counter to each other and a pair of switches G3 and G4 connected in parallel and arranged to be counter to each other. Due to this structure, the bidirectional switching devices 140 and 150 can pass currents in both forward and backward directions. Although not illustrated in the drawings, the switching operations of the switches G1 to G4 are controlled by a controller (not shown). The switches G1 to G4 are turn-on controllable power semiconductor devices. For example, the turn-on controllable power semiconductor device may be a thyristor. Examples of the turn-on/turn-off controllable power semiconductor device include a gate turn-off thyristor (GTO), an insulated gate commutated thyristor (IGCT), and an insulated gate bipolar transistors (IGBT).

In addition, in the high voltage DC circuit breaker 100 according to the embodiment of the present invention, preferably a charging resistor 160 for charging the capacitor 131 is connected between a ground GND and a contact point between the LC circuit 130 and the first bidirectional switching device. Through the charging resistor 160, the capacitor 131 of the LC circuit 130 is initially charged to a DC voltage Vc.

In addition, according to the embodiment, a non-linear resistor 170 is connected in parallel with the vacuum circuit breaker 110. The non-linear resistor 170 is to prevent an overvoltage that is higher than a rated voltage from being applied between terminals of the high voltage DC circuit breaker 100 when the vacuum circuit breaker 110 interrupts a fault current. When a voltage higher than a predetermined reference voltage is applied between the terminals of the high voltage DC circuit breaker 100 due to a certain fault, the non-linear resistor is automatically turned on to consume the high voltage. The non-linear resistor 170 can be implemented as a varistor.

Figure 3:
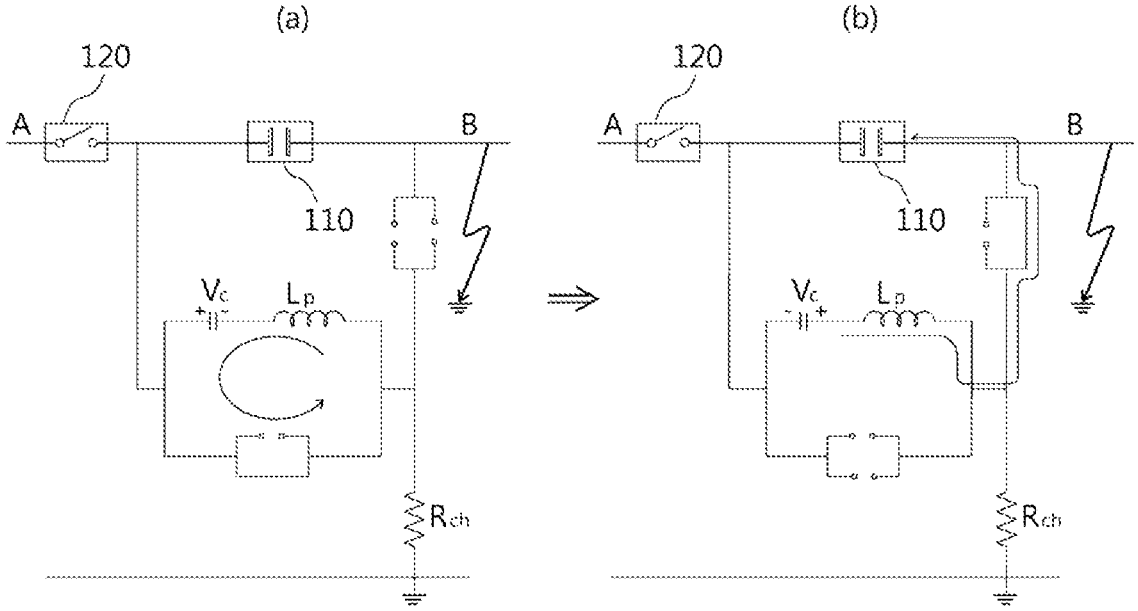
FIG. 3 is a schematic diagram illustrating a fault current interruption process in the high voltage DC circuit breaker according to the embodiment of the present invention when a fault occurs at one side on a high voltage DC transmission line.
Figure 4:
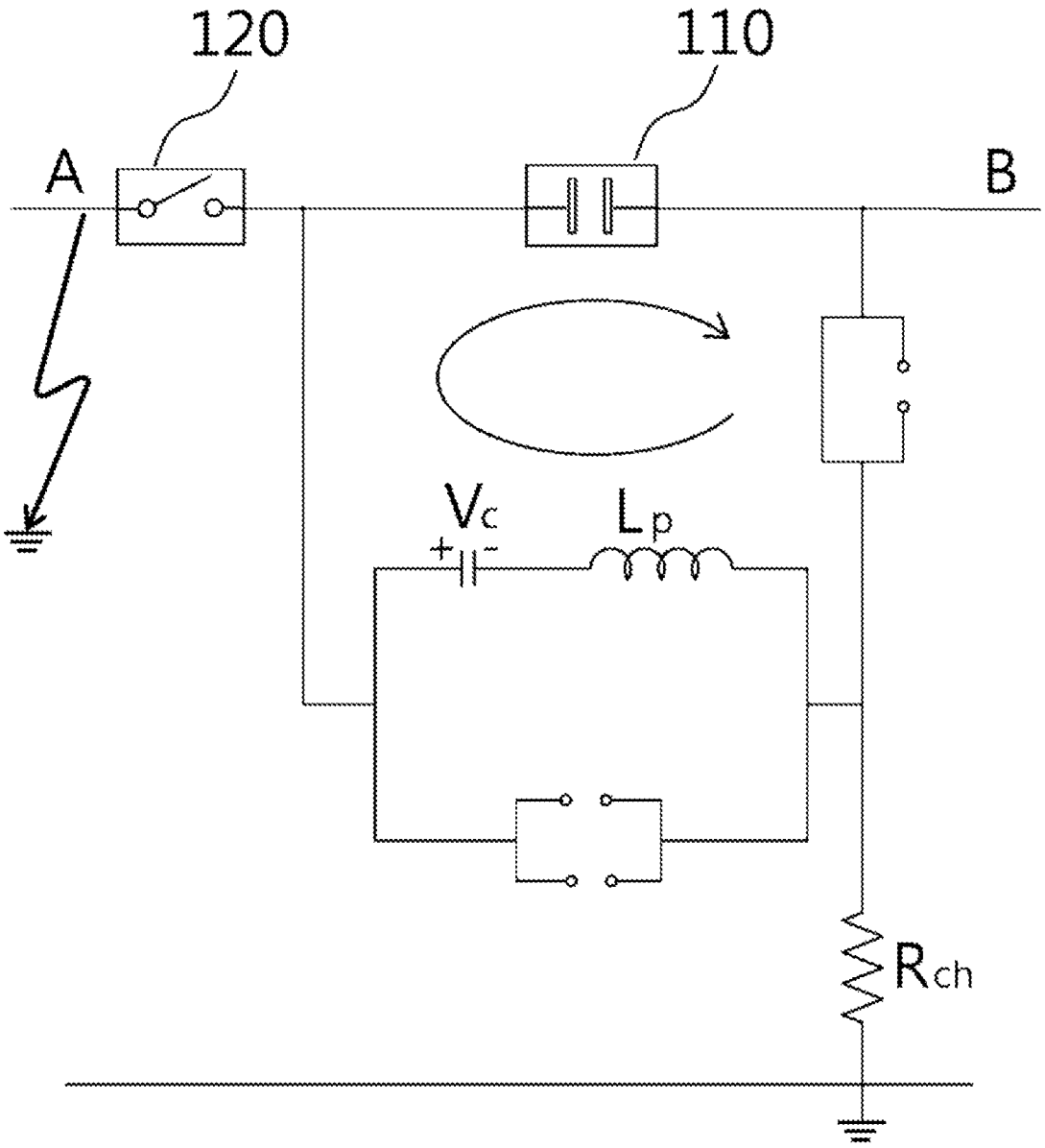
FIG. 4 is a schematic diagram illustrating a fault current interruption process in the high voltage DC circuit breaker according to another embodiment of the present invention when a fault occurs at the remaining side on the high voltage DC transmission line.

FIG. 3 is a schematic diagram illustrating a fault current interruption process when a fault occurs on one side B of the high voltage DC circuit breaker according to the embodiment of the present invention. FIG. 4 is a schematic diagram illustrating a fault current interruption process when a fault occurs on the remaining side A of the high voltage DC circuit breaker according to another embodiment of the present invention.

An operation in the case in which a current flows from the A side to the B side will be first described below. When the high voltage DC circuit breaker 100 according to the present invention is in normal condition, the two contacts of the vacuum circuit breaker 110 are in contact with each other such that a normal current flows from the A side to the B side. In this case, both of the first bidirectional switching device 140 and the second bidirectional switching device 150 are in an OFF state, thereby blocking the flow of a current. For this reason, when a high voltage is applied to the high voltage DC transmission line 10, a normal current flows through the DC transmission line 10 via the two contacts of the vacuum circuit breaker 110 and is also supplied to the capacitor 131 and the reactor 132 of the LC circuit 130 and the charging resistor 160, thereby charging the capacitor 131 to a DC voltage +Vc.

When a fault occurs at the B side, as illustrated in FIG. 3(*a*), the controller detects a fault and separates the two contacts from each other to interrupt a fault current by operating the vacuum circuit breaker 110. While the two contacts of the vacuum circuit breaker 110 are separated from each other, in the state in which both of the parallel switches G1 and G2 of the first bidirectional switching device 140 are turned off, the switch G4 that is a lower switch of the second bidirectional switching device 150 is turned on, and LC resonance occurs between the reactor 132 and the capacitor 131 through the switch G4, resulting in the capacitor 131 being charged to a voltage −Vc.

Subsequently, as illustrated in FIG. 3(*b*), the lower switch G4 is turned off, the right switch G2 of the first bidirectional switching device 140 is turned on, and a current can be supplied to the vacuum circuit breaker 110 through the right switch G2 due to the voltage −Vc charged in the capacitor 131. This supplied current makes a zero current in the vacuum circuit breaker 110, thereby interrupting a fault current.

In this case, the current supplied to the vacuum circuit breaker 110 functions to interrupt a fault current within the vacuum circuit breaker 110. Preferably, this current is counter to the fault current in the direction and larger than the fault current in the amount. In this way, the amount of the reverse current supplied to the vacuum circuit breaker to interrupt the fault current is determined depending on the capacity of the capacitor 131. Accordingly, it is preferable that the capacity of the capacitor 131 is determined depending on design conditions of a high voltage DC transmission line to which the high voltage DC circuit breaker 100 according to the embodiment of the present invention is applied.

When the fault current is interrupted in the vacuum circuit breaker 110 as described above, the voltage at the A side rapidly rises to be higher than that at the B side. For this reason, when a predetermined time elapses from the beginning of the operation of the vacuum circuit breaker 110, the gas circuit breaker 120 starts operating, thereby providing a dielectric strength to withstand the increased voltage of the A side. Specifically, since the vacuum circuit breaker 110 and the gas circuit breaker 120 are connected in series, when a fault current occurs in the DC transmission line, the vacuum circuit breaker 110 starts operating at an early stage such that the two contacts are separated from each other, thereby primarily interrupting the fault current. After that, when a predetermined time elapses, the gas circuit breaker 120 operates to block the DC transmission line. In this way, the gas circuit breaker 120 operates to insulate the A side from the high voltage. As described above, according to the present invention, the vacuum circuit breaker 110 functions to interrupt a fault current and the gas circuit breaker 120 functions to recover a dielectric strength. To this end, according to the present invention, while the vacuum circuit breaker 110 operates such that the two contacts thereof are separated from each other, when a predetermined time elapses, the gas circuit breaker 120 starts operating. In this case, the gas circuit breaker 120 starts operating before the operation period of the vacuum circuit breaker 110 terminates. That is, it is important to provide an operation overlap period during which both of the two circuit breakers 110 and 120 operate together. The reason of this operation time overlap will be described below. The vacuum circuit breaker 110 has a high current interruption performance but has a low rated voltage. Therefore, its dielectric strength for a high voltage is low, and thus a load applied to internal parts or devices is increased by the high voltage applied when the vacuum circuit breaker 110 early operates to interrupt a current. In order to reduce this load, the gas circuit breaker 120 having a high dielectric strength is configured to operate before the circuit is completely blocked by the vacuum circuit breaker 110. That is, since the vacuum circuit breaker 110 primarily interrupts a fault current, the gas circuit breaker 120 needs not include various parts for arc extinguishment, for example, an arc contact, nozzle, etc. which were necessarily provided in conventional arts, thereby simplifying the structure of the circuit breaker and rescuing the manufacturing cost thereof.

Meanwhile, when a current flows from the B side to the A side, an operation described below is performed. When the high voltage DC circuit breaker 100 according to the present invention is in normal condition, the two contacts of the vacuum circuit breaker 110 are in contact with each other such that a normal current can flow from the B side to the A side. In this case, both of the first bidirectional switching device 140 and the second bidirectional switching device 150 are in an OFF state, whereby the flow of a current is blocked. Therefore, when a high voltage is applied to the high voltage DC transmission line 10, a normal current flows through the DC transmission line 10 via the two contacts of the vacuum circuit breaker 110, and at this time the normal current that has passed the vacuum circuit breaker 110 is supplied to the capacitor 131 and the reactor 132 of the LC circuit 130 and the charging resistor 160, whereby the capacitor 131 is charged to the DC voltage +Vc.

In the case in which a fault occurs at the A side, as illustrated in FIG. 4, the controller detects the fault and separates the two contacts of the vacuum circuit breaker 110 to interrupt a fault current. While the two contacts of the vacuum circuit breaker 110 are separated from each other, both of the parallel-connected switches G3 and G4 of the second bidirectional switching device 150 are in an OFF state, and the left switch G1 of the first bidirectional switching device 140 is turned on. Thus, a current is supplied to the vacuum circuit breaker 110 due to the voltage stored in the capacitor 131 of the LC circuit 130. The supplied current makes a zero current in the vacuum circuit breaker 110 zero (0), thereby interrupting a fault current.

The current supplied to the vacuum circuit breaker 110 functions to interrupt the fault within the vacuum circuit breaker 110, and is preferably counter to the fault current in the direction and larger than the fault current in the amount. The amount of the reverse current used to interrupt the fault current is determined depending on the capacity of the capacitor. Accordingly, the capacity of the capacitor 131 is determined depending on design conditions of a high voltage DC transmission line to which the high voltage DC circuit breaker 100 according to the present invention is applied.

When the fault current is interrupted in the vacuum circuit breaker 110 as described above, the voltage at the B side rapidly increased to be larger than that at the A side. In this case, the gas circuit breaker 110 starts operating after a predetermined time elapses from the beginning of the operation of the vacuum circuit breaker 110 to provide a dielectric strength to withstand the increased voltage at the B side. That is, the vacuum circuit breaker 110 primarily operates such that the two contacts are separated from each other to interrupt a fault current, and then the gas circuit breaker 120 operates after a predetermined time elapsed from the beginning of the operation of the vacuum circuit breaker 110 to block the DC transmission line. In this way, the gas circuit breaker 120 functions to withstand the high voltage at the B side.

Even in this case, preferably the gas circuit breaker 120 starts operating before an operation period of the vacuum circuit breaker 110 terminates, thereby providing an operation overlap period during which both of the circuit breakers 110 and 120 operate together. In this case, since the vacuum circuit breaker 110 primarily interrupts a fault current, the gas circuit breaker 120 needs not include various parts for arc extinguishment, for example, an arc contact, a nozzle, etc., thereby simplifying the structure of the circuit breaker and reducing the manufacturing cost thereof.

Figure 5A:
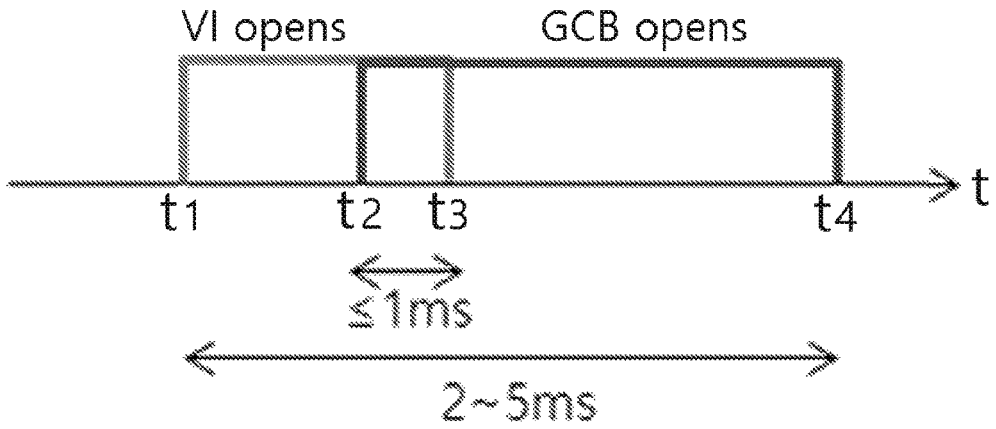
FIGS. 5A and 5B are diagrams showing operation cycles of the vacuum circuit breaker and the gas circuit breaker, and change in dielectric strength according to operation time, according to one embodiment of the present invention.
Figure 5B:
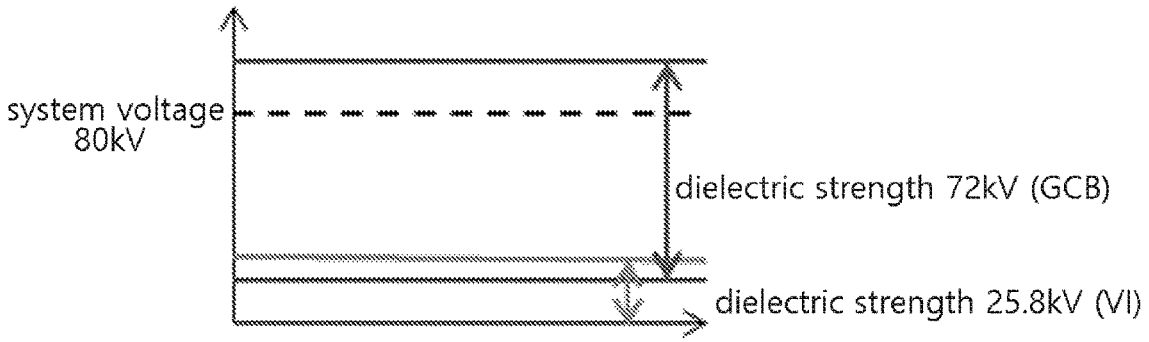

FIGS. 5A and 5B are diagrams illustrating operation cycles of the vacuum circuit breaker and the gas circuit breaker, and change in dielectric strength according to operation time.

With reference to FIG. 5A, in the high voltage DC circuit breaker 100 according to the present invention, when a fault occurs at one side or a remaining side on a DC transmission line, the vacuum circuit breaker 110 starts operating at a time point t1. The operation of the vacuum circuit breaker 110 is finished at a time point t3. In this case, before the operation of the vacuum circuit breaker 110 is finished, the gas circuit breaker 120 starts operating at a time point t2 and stops operating at a time point t4. As illustrated in the drawing, there is an operation overlap period, t2 to t3, during which both of the circuit breakers 110 and 120 operate together. According to the embodiment of the present invention, when a time, from the time point t1 at which the vacuum circuit breaker 110 starts operating to the time point at which the gas circuit breaker 120 stops operating, is 2 to 5 ms, the operation overlap period, t2 to t3, during which both of the two circuit breakers 110 and 120 operate together is preferably set to be 1 ms or shorter.

As illustrated in FIG. 5B, since the vacuum circuit breaker 110 primarily blocks the DC transmission line, a load applied to the vacuum circuit breaker 110 having a low dielectric strength for a high voltage is increased, which is likely to result in damage to internal parts or devices in the vacuum circuit breaker. Accordingly, the gas circuit breaker 120 having a high dielectric strength operates at a proper time point t2, i.e., before the load becomes excessive. In the case in which a system voltage is 80 kV or higher, the vacuum circuit breaker 110 provides a dielectric strength to withstand a voltage of 25.8 kV and the gas circuit breaker 120 provides a dielectric strength to withstand a voltage of 72 kV.

In this way, the present invention reduces a high burden to a circuit breaker, which was required in conventional arts in which a single circuit breaker needs to have a function of interrupting a fault current attributable to a high voltage and to have a high dielectric strength to withstand a high voltage of 80 kV. According to the present invention, the vacuum circuit breaker 110 and the gas circuit breaker 120 perform a fault current interruption function and a high voltage withstanding function, respectively. Therefore, the present invention can provide a high voltage DC circuit breaker that can effectively interrupt a fault current and can be manufactured at low cost.

Figure 1:
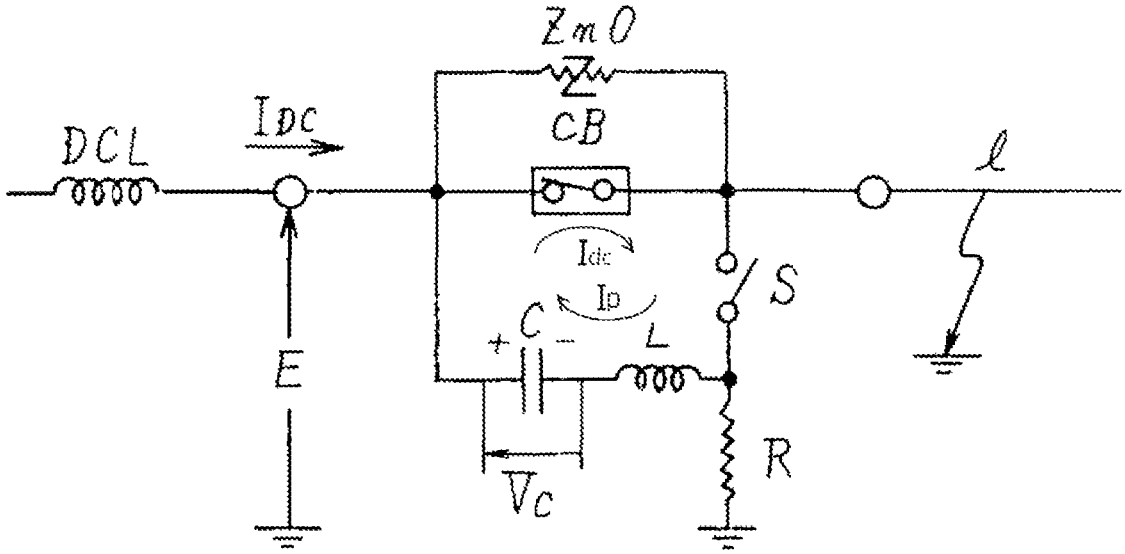
FIG. 1 PRIOR ART
FIG. 1 is a configuration diagram of a high voltage DC circuit breaker according to a conventional art.

As described above, the high voltage DC circuit breaker 100 according to the embodiment of the present invention is characterized in that the resonance current attributable to the LC resonance is not formed by the main switch CB as in the conventional art illustrated in FIG. 1 but formed by the switches G3 and G4 of the second bidirectional switching device 150. Therefore, unlike the conventional art in which the current oscillation increases through the LC resonance, the present invention is configured such that the LC resonance is induced only once to reverse the voltage polarity of the capacitor 131 of the LC circuit 130. Therefore, the interruption speed becomes faster compared with the conventional art. In addition, unlike the conventional art, the present invention is configured such that the vacuum circuit breaker 110 and the gas circuit breaker 120 are connected in series, the vacuum circuit breaker 110 functions to interrupt a fault current, and the gas circuit breaker 120 functions to provide a dielectric strength to withstand a high voltage. Therefore, the present invention can provide a DC circuit breaker that is excellent in terms of performance and cost.

Although the present invention has been described above in connection with the preferred embodiments, the present invention is not limited to the above embodiments. Those skilled in the art will appreciate that various modifications, additions, and substitutions are possible, without departing from the scope and spirit of the present invention as disclosed in the appended claims, and all of those modifications, additions, and substitutions also fall within the technical scope of the present invention. Accordingly, the substantial technical protection scope of the present invention should be defined by the technical spirit of the appended claims.

The invention claimed is:

1. A high voltage DC circuit breaker, comprising:

a vacuum circuit breaker installed on a DC transmission line and interrupting a current in the DC transmission line by operating when a fault occurs on one side or another side of the DC transmission line;

a gas circuit breaker connected in series with the vacuum circuit breaker;

an LC circuit connected in parallel with the vacuum circuit breaker and including a capacitor and a reactor connected in series with each other to induce LC resonance;

a first bidirectional switching device connected in series with the LC circuit and switching currents flowing in a forward and a backward directions; and a second bidirectional switching device connected in parallel with the LC circuit and switching currents to induce the LC resonance in the forward and the backward directions, wherein the first bidirectional switching device includes a pair of switches (G1 and G2) arranged to be counter to each other and connected in parallel, and the second bidirectional switching device includes a pair of switches (G3 and G4) arranged to be counter to each other and connected in parallel, and wherein when a current flows from one side to the another side of the DC transmission line in a normal condition, the G1, G2, G3 and G4 are in an OFF state and the capacitor is charged to a DC voltage +Vc, and when a fault occurs at the another side of the DC transmission line, in a state in which the G1 to G3 are turned off, the switch G4 is turned on, and a voltage −Vc is charged in the capacitor by the LC resonance occurring between the reactor and the capacitor through the G4, and then the G4 is turned off and the G2 is turned on, wherein the vacuum circuit breaker is supplied with a current through the G2 due to the voltage −Vc charged in the capacitor, and the current supplied from the capacitor makes a zero current between two contact points of the vacuum circuit breaker, wherein when a current flows from the another side to the one side of the DC transmission line in a normal condition, the G1, G2, G3 and G4 are in an OFF state and the capacitor is charged to a DC voltage +Vc, and when a fault occurs at the one side of the DC transmission, in a state in which the G2 to G4 are turned off, the G1 is turned on, wherein the vacuum circuit breaker is supplied with a current through the G1 due to a voltage (+Vc) that is preliminarily charged in the capacitor of the LC circuit, and the supplied current makes a zero current between the two contact points of the vacuum circuit breaker, and wherein while the two contact points of the vacuum circuit breaker are separated from each other, when a predetermined time elapses, the gas circuit breaker starts operating, and wherein the gas circuit breaker starts operating before an operation period of the vacuum circuit breaker terminates, whereby an operation time of the vacuum circuit breaker and an operation time of the gas discharge circuit partially overlap.

2. The high voltage DC circuit breaker according to claim 1, further comprising a charging resistor configured to charge the capacitor to a voltage (Vc), wherein the charging resistor is provided between a ground (GND) and a contact point between the LC circuit and the first bidirectional switching device.

3. The high voltage DC circuit breaker according to claim 1, wherein the G1 to G4 are turn-on controllable switches or turn-on/turn-off controllable switches.

* * * * *